United States Patent [19]

Mangiapane

[11] Patent Number: 4,483,533

[45] Date of Patent: Nov. 20, 1984

[54] LEG EXERCISER

[76] Inventor: Philip Mangiapane, 1201 Roebuck Ct., West Palm Beach, Fla. 33401

[21] Appl. No.: 427,691

[22] Filed: Sep. 29, 1982

[51] Int. Cl.[3] ..... A63B 21/32

[52] U.S. Cl. ..... 272/137; 272/143

[58] Field of Search ..... 272/68, 137–136, 272/140–142, 143; 273/75, 55 C; D21/198

[56] References Cited

U.S. PATENT DOCUMENTS

| | | | |
|---|---|---|---|
| D. 208,787 | 10/1967 | Bennstrom-Prescott | D21/198 |
| 3,147,012 | 9/1964 | Sullivan, Jr. | 273/75 |
| 4,022,463 | 5/1977 | Scott, Jr. | 272/142 X |

FOREIGN PATENT DOCUMENTS

| | | | |
|---|---|---|---|
| 1012574 | 6/1977 | Canada | 272/141 |
| 1167711 | 6/1954 | Fed. Rep. of Germany | 272/137 |
| 2548713 | 5/1976 | Fed. Rep. of Germany | 272/136 |
| 433319 | 8/1935 | United Kingdom | 272/137 |
| 952026 | 9/1962 | United Kingdom | 272/140 |

*Primary Examiner*—Richard J. Apley
*Assistant Examiner*—Chris Coppens
*Attorney, Agent, or Firm*—Malin, Haley & McHale

[57] ABSTRACT

A leg exerciser for simultaneously exercising the muscle groups of the inner thighs by a cortrolled compression and controlled decompression action of the leg exerciser. The leg exerciser includes an integral helical formed bias means positioned in the center of two diverging members, each distal end of which includes a pad attached thereto for comfortable engagement against the inside surface of the user's knees. The user repeatedly exerts a positive compression force against the pads to decrease the distance between the diverging members and then to decrease the force to provide controlled decompression returning the diverging members to their free state in relation to the helix bias means. The leg exerciser is usable by exerting knee-closing pressure on the pads to exercise the sartorius, gracilis, great adductor of the thigh, long adductor of the thigh, and semimembranosus muscles of the inner thigh.

1 Claim, 4 Drawing Figures

LEG EXERCISER

BACKGROUND OF THE INVENTION

This invention relates generally to exercise devices for strengthening various body muscles, and more particularly to exercise devices intended to strengthen leg muscles.

U.S. Pat. No. 4,170,351 discloses an arm, leg, and abdomen exercise assembly that allows leg exercises to be performed by using the legs to rotate a crossbar or to move the crossbar back and forth along arc lengths defined by a ball and socket assembly. Spring tension is varied by replacing the spring with a stronger or weaker spring or altering the angular portion of the socket assembly. This multi-purpose exerciser is complex, expensive to manufacture, and does not exercise the muscle groups exercised by the present invention.

U.S. Pat. No. 3,958,803 provides an exercise device having two tubes that telescope into each other and an elastic spring interconnected to grip handles to allow for push and press exercises. This exercise appliance is used for pull exercise to tone the muscular system of the legs and does not specifically exercise the muscle groups exercised by the present invention.

U.S. Pat. No. 3,971,255 allows for the exercise of muscle groups by use of a short, tubular housing, a circular shaft, collar and plunger so that the plunger can be forced against the collar and the collar compressed against the shaft. Although this exercise device may be used to exercise the muscle groups exercised by the present invention, this prior art device reveals a complex system which requires knee yokes be attached to the housing before use as a leg exerciser. Further, it appears as though a plurality of yoke sizes are required.

Prior art as discussed above exhibits complex, costly and/or non-specific exercisers for the muscle groups of the inner thighs of a person. The present invention discloses a non-complex, inexpensive device for specifically exercising the muscles of the inner thighs. The present invention is portable and ready for use requiring no assembly or adjustment.

SUMMARY OF THE INVENTION

A leg exerciser for simultaneously exercising the muscle groups of the inner thighs by a controlled compression and controlled decompression action of the leg exerciser. The leg exerciser includes an integral helical formed bias means positioned in the center of two diverging members, each distal end of which includes a pad attached thereto for comfortable engagement against the inside surface of the user's knees. The user repeatedly exerts a positive compression force against the pads to decrease the distance between the diverging members and then to decrease the force to provide controlled decompression returning the diverging members to their free state in relation to the helix bias means. The leg exerciser is usable by exerting knee-closing pressure on the pads to exercise the sartorius, gracilis, great adductor of the thigh, long adductor of the thigh, and semimembranosus muscles of the inner thigh.

It is the primary object of this leg exerciser to provide a novel and improved portable leg exerciser which employs a controlled compression and decompression of a bias means to simultaneously exercise muscles of the inner thighs.

A further object of this invention is to provide a portable leg exerciser that is simple in construction.

A still further object of the present invention is to provide a novel and improved leg exerciser that requires no adjustment before use.

And yet another object of the present invention is to provide a leg exerciser which can be utilized in a sitting or standing position.

A final object of this invention is to provide a novel and improved leg exerciser that is compact, inexpensive and adapted for home use.

In accordance with these and other objects which will be apparent hereinafter, the instant invention will now be described with particular reference to the accompanying drawings.

DRAWINGS

DETAILED DESCRIPTION OF DRAWINGS

Figure 1:
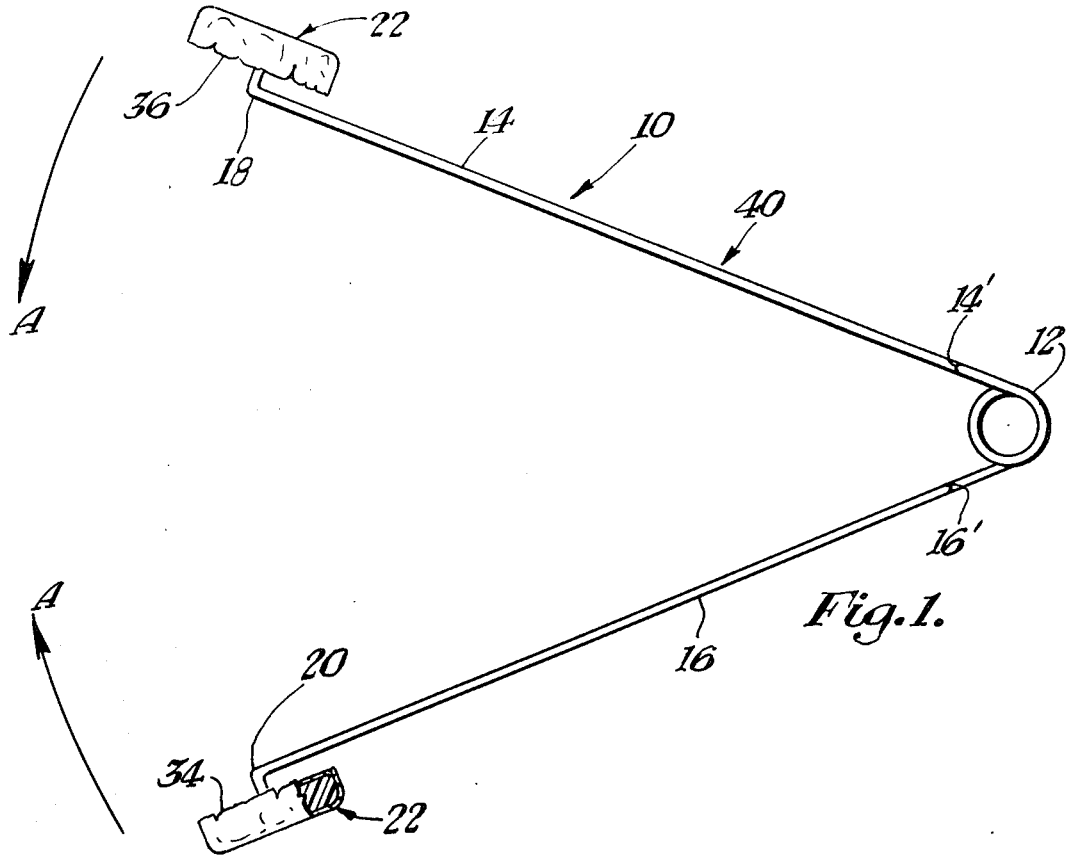
FIG. 1 is a top view of the leg exerciser in the free state.
Figure 2:
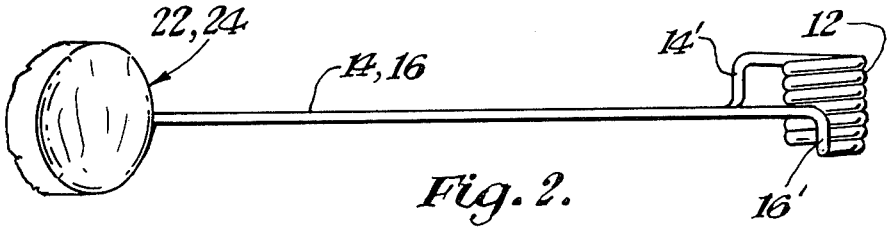
FIG. 2 is a side view of the leg exerciser.
Figure 3:
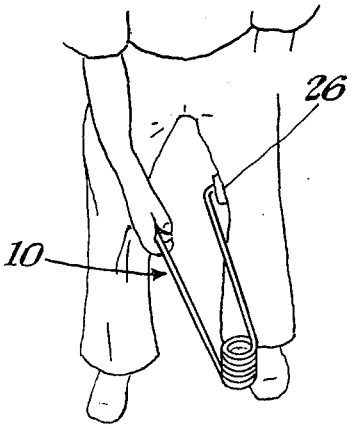
FIG. 3 is a perspective view of a user positioning the leg exerciser between the knees for use.

Referring now to the drawings, and particularly to FIGS. 1 and 2, the leg exerciser is shown generally at 10 and comprises a continuous cylindrical rod 40 and knee pads 22 connected at each end of the rod 40. The rod 40 is formed at its mid-section into a helix formed bias means 12 with bends 14' and 16' for achieving a coplaner relationship between diverging arms 14 and 16 to eliminate force imbalance whenever pads 22 are moved toward one another away from their free state. In using this leg exerciser, the controlled compression is in the direction of Arrows A in FIG. 1. The controlled decompression is in the opposite direction of Arrows A in FIG. 1. The diverging arms 14 and 16 extend from the terminal ends of the helix-formed bias means. Pads 22 are positioned to provide a broader surface for engaging the leg exerciser 10 comfortably against the user's inner knee surfaces at 26 and 26' as shown in FIG. 3.

Figure 4:
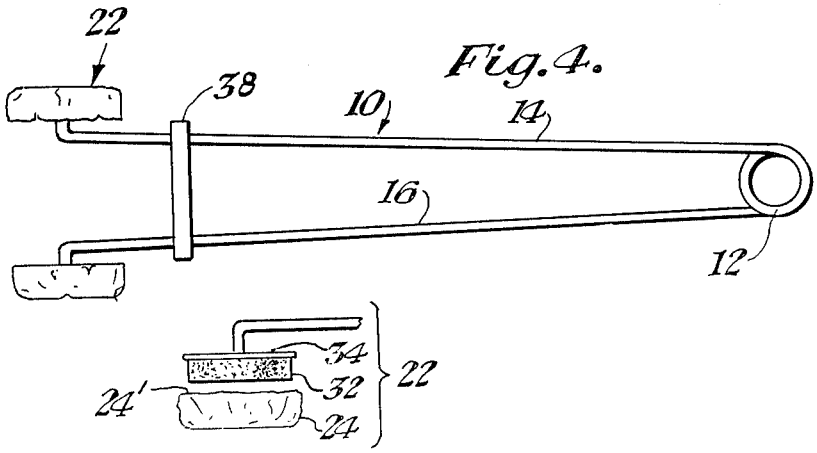
FIG. 4 is a top view of the leg exerciser held for storage in a compressed state.

The exerciser 10 is shown in FIG. 4 in its stored, compressed position, held thusly by storage bracket 38. After pads 22 are fully compressed togehter, the storage bracket 38 is placed over the adjacent arms 14 and 16, after which compressive force against the pads may be released, the arms 14 and 16 retained by the storage bracket 38 in the position shown.

FIG. 4 also shows the preferred construction of each knee pad 22 and includes a rigid disc 34 connected to the distal ends 18 and 20 of each arm, a compressible foam pad 32 attached to the opposite, outer-facing side of each disc, and a flexible cover 24 which encases the foam pad 32 and the disc 34. The flexible covers 24 are held in place by a stretchable opening 24' placed over and behind the disc 34.

The instant invention has been shown and described herein in what is considered to be the most practical and preferred embodiment. It is recognized, however, that departures may be made therefrom within the scope of the invention and that obvious modifications may occur to a person skilled in the art.

What I claim is:

1. A portable leg exerciser for exercising a person's inner thigh muscles comprising:

a continuous elongated cylindrical rod;

said rod having a helix-wound portion at the central portion of each rod, and a pair of arm portions extending divergently from either end of said helix-wound portion;

said pair of arm portions divergent from each other at an acute angle as they leave said helix-wound portion;

a pair of generally conforming inner leg pads, each said pad of said pair of pads positioned at the distal end of a different said pair of arms, one of said pads connected to the outside of each said arm;

said pair of pads movably positionable in relation to one another and to said helix-wound portion for creating exercise resistance force related to the distance between the pads, each of said arm portions terminating in an outwardly turned right angle bend;

said exerciser further comprising a pair of rigid circular discs of substantially the same radius, one each of said discs being rigidly attached and disposed perpendicularly to the inner face of a respective one of said right angle bends;

each of said pads being circular and of the same radius as each said disc, one each of said pads being abuttingly attached to the outer face of each said disc, the circumferences of each said abutting pad and said disc being substantially coincident;

each said pad comprising a soft inner portion and being substantially enveloped by an outer cloth cover;

each said disc disposed so that said discs are parallel to one another when said distal ends of said arm portions are bent together.

* * * * *